United States Patent [19]

Clinkscales et al.

[11] Patent Number: 4,664,722

[45] Date of Patent: May 12, 1987

[54] METHOD FOR PROTECTING FROM HARDENING A SELECTED REGION OF A STEEL STRUCTURE

[75] Inventors: Douglas L. Clinkscales, Houston; Stephen B. Long, Missouri City; Carl S. Wheeler, Houston, all of Tex.

[73] Assignee: Hughes Tool Company-USA, Houston, Tex.

[21] Appl. No.: 790,922

[22] Filed: Oct. 24, 1985

[51] Int. Cl.[4] ..... C21D 1/74

[52] U.S. Cl. ..... 148/14; 148/16.5; 148/16.6; 148/6.35; 427/282; 427/287

[58] Field of Search ..... 148/16.5, 14, 16.6, 148/6.19, 6.35; 427/435, 388.1, 287, 250, 282

[56] References Cited

U.S. PATENT DOCUMENTS

| | | | |
|---|---|---|---|
| 1,705,674 | 3/1929 | Merten | 266/262 |
| 2,742,382 | 4/1956 | Chambers | 148/14 |
| 3,527,624 | 9/1970 | Biretta et al. | 148/14 |
| 3,873,376 | 3/1975 | Ritzka | 148/16.5 |
| 4,062,702 | 12/1977 | Kunst et al. | 148/14 |
| 4,102,838 | 7/1978 | Scales | 148/165 |
| 4,165,243 | 8/1979 | Sarnes et al. | 148/16.5 |
| 4,204,437 | 5/1980 | Espana | 76/108 A |

*Primary Examiner*—Christopher W. Brody
*Attorney, Agent, or Firm*—Robert A. Felsman

[57] ABSTRACT

A method for hardening a selected region of a steel bearing surface of an earth boring bit using the steps of stretching a rubber protector over a seal region to be protected from treatment (the rubber being selected from the group consisting of silicone, neoprene and nitrile), exposing the bearing surface and protector to a medium (selected from the group consisting of carburizing, nitriding, carbonitriding, siliconizing, chromizing and boronizing) of the type for altering the chemical composition of the steel to be hardened, heating the medium and bearing surface, cooling the bearing and protector, and removing and cleaning the surface.

5 Claims, 1 Drawing Figure

METHOD FOR PROTECTING FROM HARDENING A SELECTED REGION OF A STEEL STRUCTURE

BACKGROUND OF THE INVENTION

1. Field of the Invention

This invention relates to metallurgical treatments of steels, especially to methods for hardening only selected regions of a steel surface or structure.

2. Description of the Prior Art

One branch of metallury consists of those treatments used to harden steel surfaces. Hardening treatments may be selected from the group consisting of carburizing, nitriding, carbonitriding, siliconizing, chromizing and boronizing, or combinations of these treatments such as carburizing and boronizing.

A combination of carburizing and boronizing methods is disclosed in U.S. Pat. No. 3,922,038, Wear Resistant Boronized Surfaces and Boronizing Methods, Nov. 25, 1975, which is used commercially to harden the friction bearing surfaces of earth boring bits used to drill oil, gas and other mineral producing wells.

The area around each seal of an earth boring bit having a boronized friction bearing surface is generally protected from the boronizing treatment. Protection by masking may be achieved by copper plating or application of one of a variety of lacquers, pastes or clays. Masking is achieved mechanically in the manufacture of other products with a wrought steel plate or a powdered metallurgical composition, U.S. Pat. No. 4,165,243, Method of Making Selectively Carburized Forged Powder Metal Parts, Aug. 21, 1979. Also, masking with a protective covering body consisting of glass ceramics machinable with conventional work tools is known, U.S. Pat. No. 3,873,376, Method For Case Hardening Workpieces, Mar. 25, 1975.

One effective masking method in the manufacture of earth boring bits uses a split steel ring to meter the height of the nonboronized seal area. A masking clay is worked into the area between the friction (journal) bearing surface and a bevel on the ring. Additional clay is used to seat the boronizing cup before being packed with boronizing compound. Even though effective, there are problems with this method. It is time consuming and relatively costly to use the combination of steel ring and clay. When the cup and steel ring are removed after the boronizing furnace treatment, the seal area is sometimes scratched by the edges of the ring. Then it is sometimes necessary to rework or scrap the bearing and its supporting head section.

SUMMARY OF THE INVENTION

It is the general object of the invention to achieve a masking method used with metallurgical hardening treatments—especially in the manufacture of earth boring bits—that can be easily and quickly applied to protected regions to increase manufacturing production rates. And also one unlikely to produce scratches on treated but as yet unhardened surfaces to eliminate reworking and scrap.

This object is achieved by stretching an elastomeric protector around a region of a steel structure to be protected from hardening. If a pack treatment is to be used, the compound in the container is sealed against the elastomeric protector. In any event the steel to be treated is exposed to a medium of the type used to alter the chemical composition of the surface of the steel, which normally includes selection from the group consisting of carburizing, nitriding, carbonitriding, siliconizing, chromizing and boronizing. After heating and then cooling, the rubber protector is charred and may be easily and quickly removed, the steel surface cleaned, and additional processing such as quenching performed. The best protector is of silicone rubber but good results are achieved also with neoprene rubber. The elastomeric is a rubber selected from the group consisting of silicone, neoprene and nitrile.

The above as well as additional objects, features, and advantages of the invention will become apparent in the following detailed description.

DESCRIPTION OF THE PREFERRED EMBODIMENT

Figure 1:
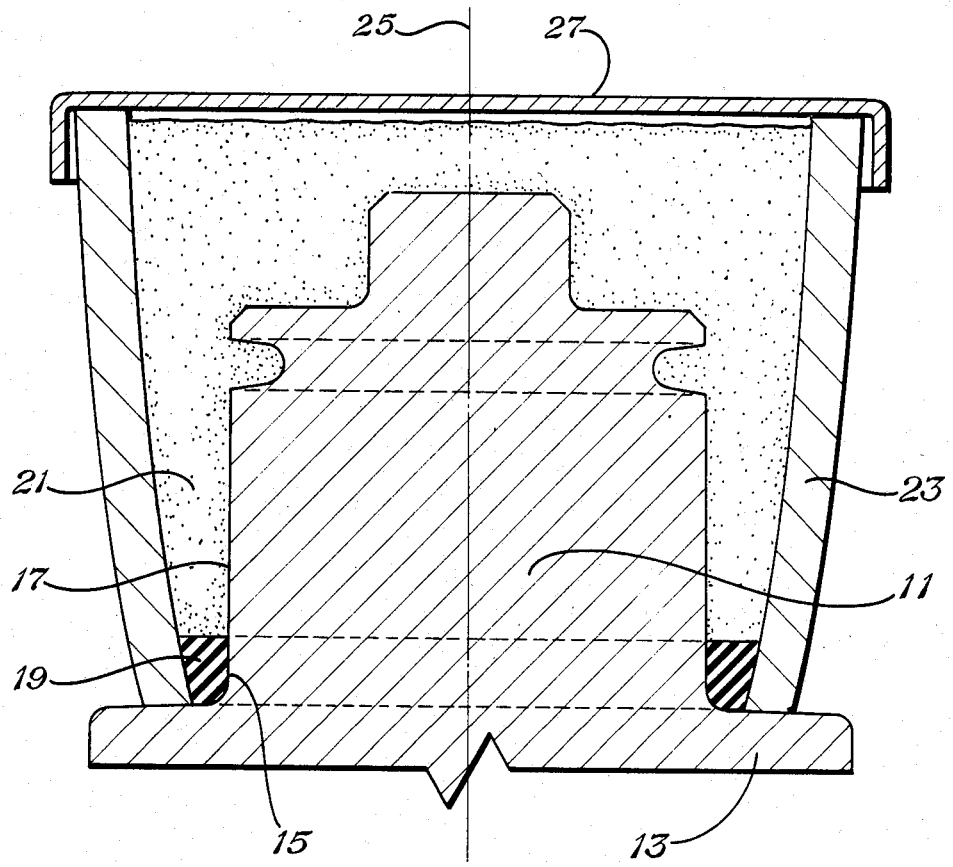
FIG. 1 is the sole FIGURE of the drawing and illustrates in fragmentary, longitudinal section a portion of one head section of an earth boring bit. The bearing is surrounded by a boronizing compound in a container, positioned by an elastomeric protector ring that mask and protects the seal area from boronizing.

The numeral 11 of the drawing designates a journal bearing region that depends from a steel structure, in this instance a head section 13 of an earth boring bit. A seal region 15 (to be protected from surface treatment) on the journal bearing surface 17 has an elastomeric protector 19 with an inside diameter slightly smaller than the diameter of the journal bearing surface 17. Hence the protector 19 is stretched over the journal bearing surface 17 to form a tight seal that prevents a surface treatment compound 21 from reaching the seal region 15, while exposing the remaining portion of the journal bearing surface 17 to the surface treatment medium (here a boronizing compound). Also, the container 23 that confines the boronizing compound 21 has it lower region engaging, and sealed by, the outer surface of the protector 19. This positions the container such that it is essentially concentric with the axis 25 of the bearing surface 17. A lid 27 further confines the boronizing compound within the container 23.

The apparatus and composition above are useful in the performance of a method used to accomplish the above described objects of the invention.

The steps of the method include stretching the elastomeric protector 19 over the journal bearing surface 17 to a position to protect the designated seal area 15. The container 23 is positioned with its lower region in contact with, and positioned by, the protector 19. A medium, which is in this instance a particulate boronizing compound, fills the container 23 and surrounds the bearing surface 17. Thus, selected surfaces of the bearing surfaces are exposed to the treatment medium.

Then, the entire head section, with its protector, boronizing compound and container, are heated in a furnace to a temperature and for a time sufficient to result in the boronizing of the journal bearing surface 17.

When removed from the furnace, the head section, container, compound and protector are cooled to permit disassembly. The protector 19 becomes charred during the treatment and may be easily removed by brush from seal region 15 of the journal bearing surface 17, followed by hot water wash. This enables further heat treatment such as quenching in the event combination of boronizing and carburizing are utilized as explained in U.S. Pat. No. 3,922,038, Wear Resistant Boronized Surfaces and Boronizing Methods, Nov. 25, 1975.

Hardening by quenching and tempering follow (in the event of dual carburizing and boronizing), and then the bearing surface 17 and seal region 15 are blasted with glass beads to provide the final, smooth surface finish.

The boronizing and carburizing steps above are but two of a well known class of treatments that achieve surface hardening by means of altered surface chemical composition. The selected treatment is therefore one of a class selected from the group consisting of carburizing, nitriding, carbonitriding, siliconizing, chromizing and boronizing--a group which also inherently includes combination treatments such as carborizing and boronizing.

The material used to form the elastomeric protector is preferably a synthetic rubber which is designed for high temperature environments and which exhibits some degree of chemical inertness. The preferred material is selected from the group consisting of silicone rubbers, nitrile rubbers and neoprene rubbers. A typical silicone rubber suitable for the present purpose is a peroxide cured methyl, vinyl polysiloxane having a crystalline silica filler. A typical nitrile rubber is a sulfur cured acrylonitrile-butadiene having carbon black filler. A suitable neoprene rubber is a peroxide cured 2-chloro-1,3 butadiene having a crystalline silica filler. The preferred material is the silicone rubber.

While the invention has been described in only a few of its forms, it should be apparent to those skilled in the art that it is not thus limited, but is susceptible to various changes and modifications without departing from the spirit thereof.

We claim:

1. A method for hardening a selected region of a steel structure, comprising the steps of:

stretching an elastomeric protector around a selected region of the steel structure to be protected from hardening;

exposing at least a portion of the steel structure, including the elastomeric protector, to a pack compound surface treatment medium of the type for altering the chemical composition of the surface of a steel;

heating the pack compound surface treatment medium, exposed portion of the steel structure and the elastomeric protector to a temperature for a duration to alter the chemical composition of the exposed portion of the steel;

cooling the steel structure and the elastomeric protector;

removing the elastomeric protector from the steel structure.

2. A method for hardening a selected region of a steel structure, comprising the steps of:

stretching a rubber protector around a selected region of the steel structure to be protected from hardening;

exposing at least a portion of the steel structure, including the rubber protector, to a pack compound surface treatment medium of the type for altering the chemical composition of the surface of a steel, selected from the group consisting of carburizing, nitriding, carbonitriding, siliconizing, chromizing and boronizing;

heating the pack compound surface treatment medium, exposed portion of the steel structure and the rubber protector to a temperature for a duration to alter the chemical composition of the exposed portion of the steel;

cooling the steel structure and the elastomeric protector;

removing the rubber protector from the steel structure;

quenching and tempering the surface of the steel structure.

3. A method for hardening a selected region of a steel structure, comprising the steps of:

stretching a rubber protector around a selected region of the steel structure to be protected from hardening, the rubber being selected from the group consisting of silicone, neoprene and nitrile;

exposing at least a portion of the steel structure, including the rubber protector, to a surface treatment medium of the type for altering the chemical composition of the surface of a steel, selected from the group consisting of carburizing, nitriding, carbonitriding, siliconizing, chromizing and boronizing;

heating the surface treatment medium, exposed portion of the steel structure and the rubber protector to a temperature for a duration to alter the chemical composition of the exposed portion of the steel;

cooling the steel structure and the elastomeric protector;

removing the rubber protector from the steel structure;

hardening the surface of the steel structure.

4. A method for hardening a selected region of a steel structure, comprising of the steps of:

stretching a silicone rubber protector around a selected region of the steel structure to be protected from hardening;

exposing at least a portion of the steel structure, including the silicone rubber protector, to a boronizing treatment;

cooling the steel structure and the silicone rubber protector;

removing and cleaning the silicone rubber protector from the steel structure.

5. A method for hardening a selected region of a steel structure, comprising the steps of:

stretching a silicone rubber protector around a selected region of the steel structure to be protected from hardening;

packing a boronizing compound inside a container and around the selected region of the steel structure, including the silicone rubber protector;

heating the boronizing compound and at least the selected region of the steel structure to a temperature at a duration to achieve effective boronizing;

cooling the boronizing compound, steel structure and the silicone rubber protector;

removing and cleaning the silicone rubber protector from the steel structure.

* * * * *